US005819635A

United States Patent [19]

Moonen

[11] Patent Number: 5,819,635

[45] Date of Patent: Oct. 13, 1998

[54] HYDRAULIC-PNEUMATIC MOTOR

[76] Inventor: Raymond J. Moonen, 535 6th St. Apt. 112, Avon, Minn. 56310

[21] Appl. No.: 807,249

[22] Filed: Feb. 28, 1997

Related U.S. Application Data

[63] Continuation-in-part of Ser. No. 769,873, Dec. 19, 1996.

[51] Int. Cl.[6] ..... F01B 7/10

[52] U.S. Cl. ..... 92/65; 92/66

[58] Field of Search ..... 92/65, 66; 60/325

[56] References Cited

U.S. PATENT DOCUMENTS

| | | | |
|---|---|---|---|
| 1,027,957 | 5/1912 | Withers et al. . | |
| 3,086,470 | 4/1963 | Skipor et al. | 417/375 X |
| 5,009,068 | 4/1991 | Clarke | 92/65 X |
| 5,341,725 | 8/1994 | Dick | 92/66 |
| 5,483,796 | 1/1996 | Ando | 92/65 X |

*Primary Examiner*—Hoang Nguyen
*Attorney, Agent, or Firm*—Albert W. Watkins

[57] ABSTRACT

A hydraulic motor has a longitudinally extended piston cylinder divided longitudinally into two separate and distinct fluid passages by a central divider. Longitudinally midway about the extended piston cylinder is attached a large center piston which provides the primary driving force for operation of the hydraulic motor. Pressurized fluid passes through one fluid passageway formed by the extended cylinder and central divider, and then through ports formed in the piston cylinder into a chamber. The pressurized fluid drives the large center piston, and therefore the piston cylinder, towards the source of fluid pressure being admitted into the piston cylinder. Pressurized fluid is thereby ported from a pressure chamber through the cylinder beyond the longitudinal midway point, and then passed through the cylinder wall to the power piston surface. In a similar manner, vacuum fluid is admitted into the remaining fluid passageway within the piston cylinder from an end opposite of the pressure fluid, and passed beyond the longitudinal midway point where it passes through the cylinder wall to the power piston on a surface opposite of the pressurized fluid. A power plant using the motor and an energy converter are also disclosed.

10 Claims, 3 Drawing Sheets

HYDRAULIC-PNEUMATIC MOTOR

CROSS REFERENCE TO RELATED APPLICATIONS

This application is a continuation-in-part of copending application Ser. No. 08/769,873 filed Dec. 19, 1996 and copending herewith.

BACKGROUND OF THE INVENTION

1. Field of the Invention

The present invention pertains to fluid motors of the expansible chamber type and to power plants incorporating such motors. More particularly, the preferred embodiment of the present invention uses non-compressible hydraulic fluid as the working fluid, with compressed air as the pressure source.

2. Description of the Related Art

Fluid motors have been in widespread use for many years. These motors generally use few moving parts, with the fluid in most instances acting as a lubricant to reduce wear of those moving parts during operation. Enormous forces may be transmitted by the fluid through long and winding passageways or conduits with little, if any, loss, using non-compressible fluids generally referred to as hydraulic fluids. These motors offer great advantage in applications requiring separation between pressure source and motor, as well as applications requiring large force to weight ratios.

In addition, fluid motors usually operate without the operator being exposed to hazards commonly associated with other types of motors. For example, gasoline and other similar internal combustion engines burn volatile, explosive fuels. In the process, the fuel must be introduced directly into a hot combustion chamber, and then toxic combustion by-products must be removed. Leaks in the fuel supply have caused countless fires, while inadequate ventilation has led to many deaths due to asphyxiation.

Electric motors are often used in areas without ventilation or where the presence of a volatile fuel is unacceptable. Once again, delivery of energy to the motor proves to be problematic. Electric motors require wiring and high voltages. While wiring may be designed to be well-protected, countless people have been electrocuted, and many more severely shocked. Moreover, large forces are difficult to obtain with electric motors, and large gear boxes are required to increase the force delivered. Such gearboxes add weight and often are more expensive than the motor.

Hydraulic motors, on the other hand, alleviate these problems. In the event of a leak, hydraulic fluid is dripped or gently sprayed into the surroundings. The wear parts are most commonly the seals, which are readily replaced. Hydraulic motors are also noted for reliability in extreme conditions, and so are found in highly demanding environments such as in vehicular braking systems.

One early disclosure of hydraulic motors is in U.S. Pat. No. 1,027,957 to Withers and Harris. Therein, a hydraulic piston 13 is moved to and fro within a cylinder 12. Direction of movement of piston 13 is controlled through valve 29, which merely reverses the side of piston 13 to which a pressurized fluid is applied. Many other hydraulic systems have been used in the prior art where the hydraulic fluid is merely passed from the pressurized side of the piston back into an ambient, where the fluid will once again be collected and pressurized by the hydraulic pump.

These hydraulic motors of the prior art, due to their design, failed to fully utilize the energy available from the hydraulic fluid. The release of hydraulic fluid results in an undesirable loss of efficiency. Furthermore, the hydraulic pump of the prior art may incorporate many of the undesirable features of the alternative prior art motors, such as requiring electricity or chemical fuel sources.

SUMMARY OF THE INVENTION

In one embodiment of the invention, a hydraulic motor has a longitudinally extended piston cylinder divided longitudinally into two separate and distinct fluid passages by a divider. Longitudinally midway about the extended piston cylinder is attached a large piston which provides the primary driving force for operation of the hydraulic motor. Pressurized fluid passes through one fluid passageway formed by the extended cylinder and divider, and then through ports formed in the piston cylinder into a chamber. The pressurized fluid drives the piston, and therefore the piston cylinder, towards the source of fluid pressure being admitted into the piston cylinder. Pressurized fluid is thereby ported from a pressure chamber through the cylinder beyond the longitudinal midway point, and then passed through the cylinder wall to the power piston surface. In a similar manner, vacuum fluid is admitted into the remaining fluid passageway within the piston cylinder from an end opposite of the pressure fluid, and passed beyond the longitudinal midway point where it passes through the cylinder wall to the power piston on a surface opposite of the pressurized fluid.

In a second embodiment of the invention comprising a power plant, valves control the pressure state of working fluid within working and auxiliary chambers, which in turn will cause the piston cylinder to oscillate within the working chamber.

In a second aspect of the invention, the hydraulic motor is combined with a pressure source and an energy converter. The energy converter converts pressurized working fluid from a single port into pressurized fluid passed through a first port and reduced pressure fluid passed through a second port.

The pressure source is preferably pneumatic, which provides the necessary store of energy, or push, to initiate motion within the hydraulic motor.

OBJECTS OF THE INVENTION

A first object of the invention is to provide a very high efficiency motor capable of extended operation. A further object of the invention is to provide a relatively safe and environmentally friendly power plant which is both durable and economical. An additional object of the invention is to provide a power plant of design relatively independent of size and scaling, to allow scaling to meet particular application requirements. These and other objects are achieved in the present invention, a better understanding of which may be obtained through the following description and drawings of the preferred embodiment.

DESCRIPTION OF THE PREFERRED EMBODIMENT

Figure 1:
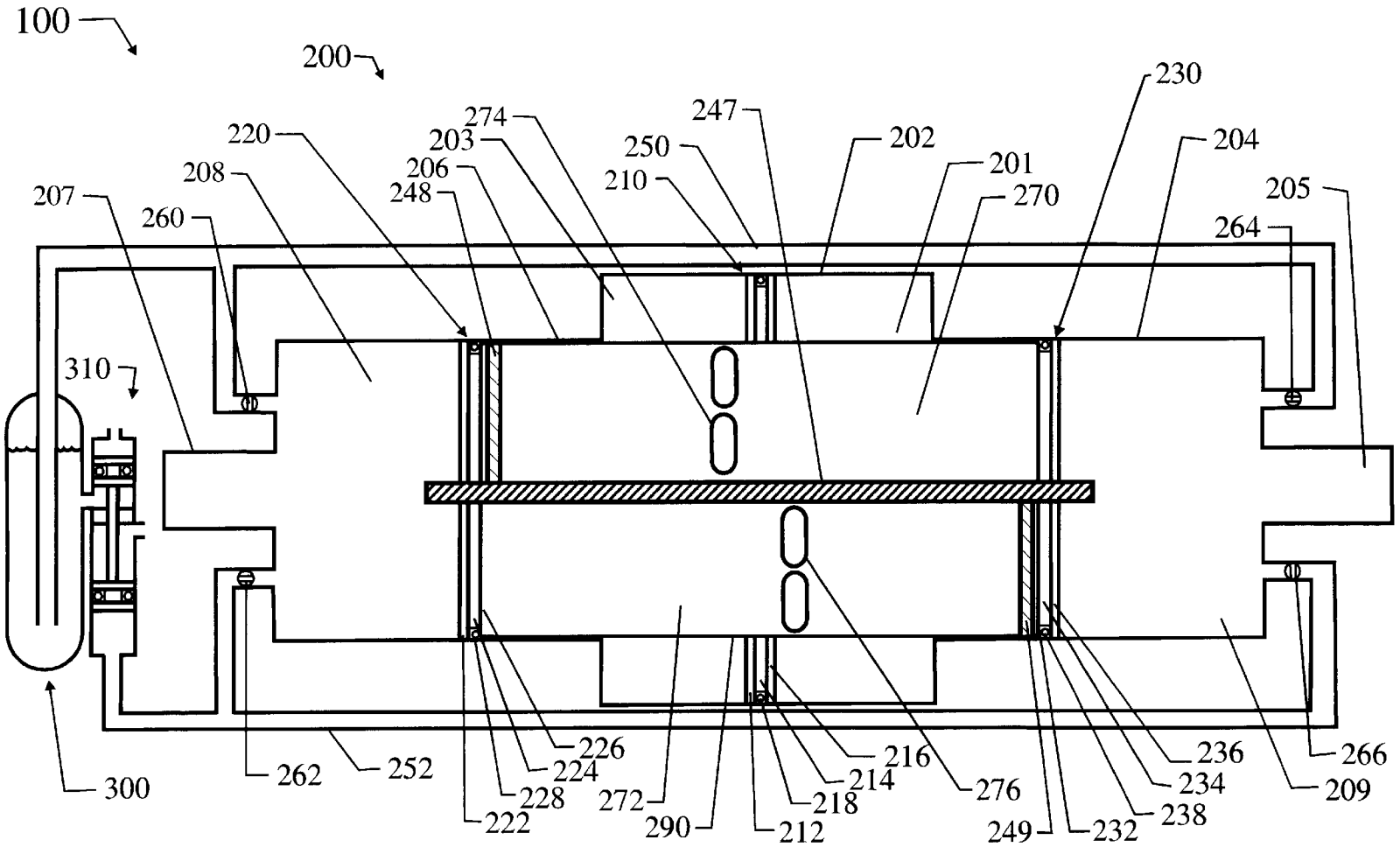
FIG. 1 illustrates a preferred embodiment of the hydraulic-pneumatic power plant through a combined side cross-section and schematic view.

Hydraulic-pneumatic power plant 100 includes hydraulic-pneumatic motor 200, pressure reservoir 300 and energy converter 310. Pressure reservoir 300 acts as an accumulator, or large storage tank of pressurized working fluid 301. For the purposes of the present invention, working fluid 301 will be understood to be a relatively non-compressible liquid as known in the art, such as hydraulic liquid. Pressurized working fluid 301 is transmitted to energy converter 310 for conversion from a source for pressurized fluid into a suction source, hereinafter referred to as a suction source, vacuum source, vacuum fluid or vacuum line. Pressurized and vacuum fluids are separately transmitted, as will be described in more detail hereinbelow, to the hydraulic-pneumatic motor 200, where motion is generated.

Hydraulic-pneumatic motor 200 has a center piston 210, right seal 230 and left seal 220. Piston 210 and seals 220 and 230 are rigidly interconnected to piston cylinder 290 through means known in the art, among which may be welds and other such forms of attachment. Left retaining lip 222 and right retaining lip 226 form the borders of seal gap 224 into which O-ring seal 228 is located. Similarly, left retaining lip 212 and right retaining lip 216 form the borders of seal gap 214 into which O-ring seal 218 is located. Left retaining lip 232 and right retaining lip 236 form the borders of seal gap 234 into which O-ring seal 238 is located.

While the preferred embodiment incorporates grooves and seal rings, one skilled in the art will recognize the many variations are known which may be adapted to the present motor 200. For example, threaded nuts and connecting rods as illustrated in the parent application, incorporated herein by reference, may be used. The particular details of any individual seal is not considered consequential to the invention, other than for considerations notorious in the art.

Piston 210 and seals 220 and 230 each oscillate within a matched diameter power chamber delineated by a power chamber wall. Center power chamber wall 202 forms a cylindrical chamber around center piston 210, right power chamber wall 204 forms a cylindrical chamber around right seal 230 and left power chamber wall 206 forms a cylindrical chamber around seal 220. Two additional power chamber walls 205 and 207 are provided at the right and left ends of motor 200, respectively. Chamber walls 205 and 207 form end enclosures for motor 200, and may be removed or passed through by a shaft to transmit energy out of motor 200, as will be described in more detail hereinafter.

Between left seal 220 and center piston 210 is main fluid chamber 203, and between right seal 230 and center piston 210 is main fluid chamber 201. Two additional auxiliary fluid chambers are provided. Auxiliary chamber 208 is left of left seal 220 and auxiliary chamber 209 is right of right seal 230.

Pressure is provided to motor 200 through pressurized hydraulic line 250, and vacuum or suction force is provided through vacuum hydraulic line 252. Four valves control the transmission of pressure and suction through working fluid 301. On the left side within chamber 208, pressure is admitted from line 250 through valve 260, while vacuum is admitted from line 252 through valve 262. The valves are controlled by a common actuator so that when valve 260 is open, valve 262 is closed, and when valve 262 is open, valve 260 will be closed. On the right side within chamber 209, pressure is admitted through valve 264, while vacuum is admitted through valve 266. These valves are also controlled by a common actuator so that when valve 264 is open, valve 266 is closed, and when valve 266 is open, valve 264 will be closed.

The actuator, which is not illustrated, may either be electrically controlled or mechanically controlled. Devices of this nature, which activate one valve while simultaneously de-activating another valve, are known in the hydraulics art and come in mechanical or electrical form. In one embodiment of the invention, which is described solely for a complete understanding, sprockets for each valve are coupled by a chain. A rotary source, which might be a handle or a motorized drive sprocket, engages with the sprockets and chain. Pressure valves 260 and 266 are oriented 90 degrees from the orientation of vacuum valves 262 and 264, such that during each 90 degree rotation pressure is applied in one of chambers 208 and 209, while vacuum is applied in the other, with pressure and vacuum alternating within a single chamber as the valves are rotated by the chain and sprockets.

Referring to FIG. 1, valve 260 is shown as being closed, while valve 262 is open. Chamber 208 is, therefore, drawing a suction force equal to the suction force within line 252. Valve 264 is open, while valve 266 is closed. Therefore, chamber 209 is pressurized to the pressure of working fluid 301 in line 250.

Since working fluid 301 is non-compressible, there will be no substantive movement of working fluid when valves 260–266 are rotated. However, the pressure and suction forces will be communicated through the fluid. In the preferred embodiment, pressure line 250 carries a force of 100 pounds per square inch, while vacuum line 252 will be drawing a vacuum force of 100 pounds per square inch. These forces are, of course, a function of the designer's intended objectives and the strength and materials selected for chamber walls, pistons, etc.

Figure 2:
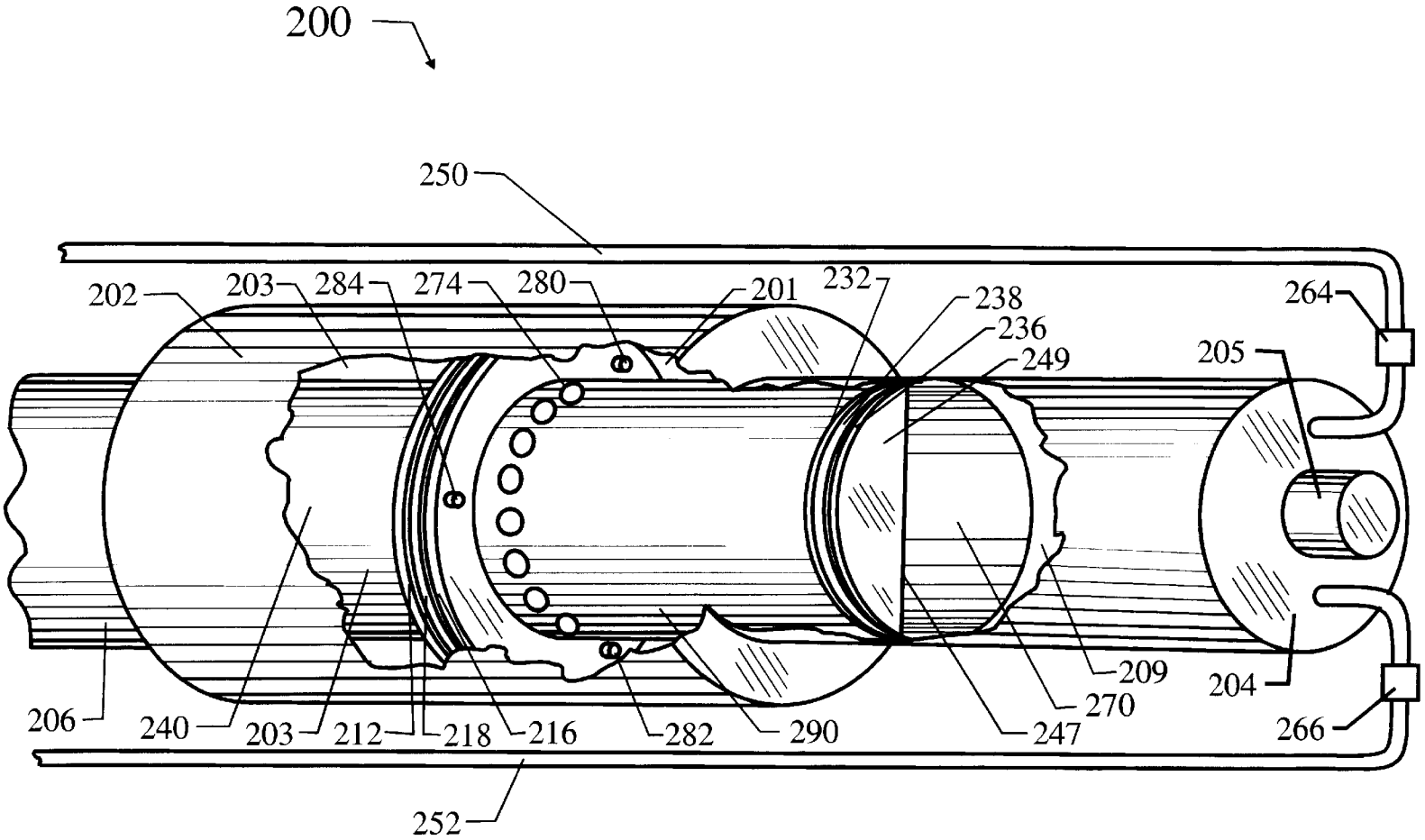
FIG. 2 illustrates the hydraulic-pneumatic motor of the preferred embodiment shown in FIG. 1 from a projected view with a wall of the chamber cut away.

Once a suction force is applied to chamber 208, the suction force will be communicated to chamber 201 through passageway 272 and ports 276. Ports 276 are holes machined through piston cylinder 290. While these are illustrated as slots in FIG. 1 and holes in FIG. 2, one of skill in the art will understand that these ports may take up any reasonable portion of cylinder 290, so long as they allow passage of fluid only between the appropriate passageway and the appropriate chamber, and are not so enlarged as to seriously weaken the structural integrity of cylinder 290. Similarly, the pressure force will be communicated through passageway 270 and ports 274 from chamber 209 into chamber 203. In the embodiment having 100 psi of pressure and vacuum, piston 210 will, on right retaining lip 216 have a suction force of 100 psi. applied thereto. On left retaining lip 212 a pressure force of 100 psi. is applied. In that embodiment of the invention, piston 210 has a diameter of 12 inches. Both the suction force on lip 216 and the pressure force on lip 212 are acting in the same direction, forcing piston 210 to the right. Passageway 270 is prevented from fluid communication with chamber 208 by semicircular closure wall 248, and passageway 272 is prevented from fluid communication with chamber 209 by semicircular closure wall 249.

Thousands of pounds of force are generated by this preferred embodiment. However, other embodiments are conceived of having different ratios of sizes between piston 210 and seals 220 and 230, one being that of the surface areas of piston 210 much more nearly equals the surface area of top semicircular closure wall 248 and bottom semicircular closure wall 249. In the preferred embodiment, piston 210 and semicircular closure walls 248 and 249 are illustrated as having relatively flat surfaces extending perpendicular to the axis of motion. However, there is no requirement that this be so. The important factor is the effective surface area which is parallel to the axis of motion, which, for the purposes of this disclosure, shall be referred to herein as the working surface area. Against this working surface area working fluid 301 is applied at a pressure or vacuum force, thereby generating a force tending to move the working surface.

Once piston 210 has completed travel to the right, valves 260–266 may be rotated ninety degrees, thereby reversing pressures and suction, and drawing piston 210 to the left, once again with thousands of pounds of force. In one embodiment shown in FIG. 2, piston 210 may be provided with small piston travel stops 280, 282 and 284 which act as cushions to prevent damaging impacts from occurring between piston 210 and the ends of chamber wall 202. Stops 280–284 also serve to ensure the passage of hydraulic fluid into the working surface, thereby preserving fall force generated from the working surface area.

Sensors may be used to detect the position of pistons 210, 220 and 230, or to sense the vibrations induced by stops 280–284. The sensors may then be used in known way to rotate valves 260–266 and reverse motion in motor 200.

Motor 200 may be provided with a shaft extending parallel to connecting central divider 247 or even extending directly therefrom. Such a shaft would extend through a chamber wall, such as right connecting rod chamber wall 205, and wall 205 would then include a hydraulic seal therein. The reciprocating shaft then acts as a source of motive power for other applications, including but not limited to electrical generation and direct motive power.

By the present design of the system, hydraulic fluid is transferred internally within motor 200 during movement of piston 210 and is therefore conserved. For example, given the valving arrangement shown in FIG. 1, piston 210 will be moved to the right. As this movement takes place, working fluid 301 is displaced from chamber 201. But, since chamber 203 is in communication with chamber 208, fluid 301 from chamber 201 is transferred to chamber 208. A similar transfer of fluid 301 occurs between chambers 203 and 209.

The transfer of fluid through passageways 270 and 272 is critical. However, various numbers of passageways, having various different dimensions have been conceived of. In the preferred embodiment, there are two passageways The rate at which the pistons 210, 220 and 230 travel from one side to the other is limited, in cases of no external load, by the speed at which the hydraulic fluid may be moved through the passageways. The speed of transfer is a function of the forces generated by piston 210, the size of ports 274, 276 and the viscosity and rheology of working fluid 301. As piston 210 approaches one end of travel, either ports 274 or ports 276 will become progressively more covered by the start of chamber wall 206 or 204, respectively. By so reducing the size of ports 274 or 276, the resistance of fluid flow is increased. Where desirable, a more viscous hydraulic fluid may be used to slow the passage through reduced size ports 274 and 276, thereby serving as a hydraulic cushion to reduce the impact of piston 210 at each end of travel.

Ports 274 and 276 may be spaced from piston 210 or may be placed adjacent thereto, depending upon the expected motor loading and desired effect. Placing ports 274, 276 adjacent piston 210 ensures communication of vacuum working fluid to the full end of travel of piston 210. This is necessary where full forces are required from power plant 100 throughout the stroke of piston 210. Where piston 210 has more force than required for a given application, or more travel distance than needed for that application, the reversal of piston 210 may be cushioned somewhat by spacing ports slightly from piston 210. At the end of travel, ports 210 may just be completely cut off, reducing the driving force on piston 210 by half just prior to switching valves 260–264.

Figure 3:
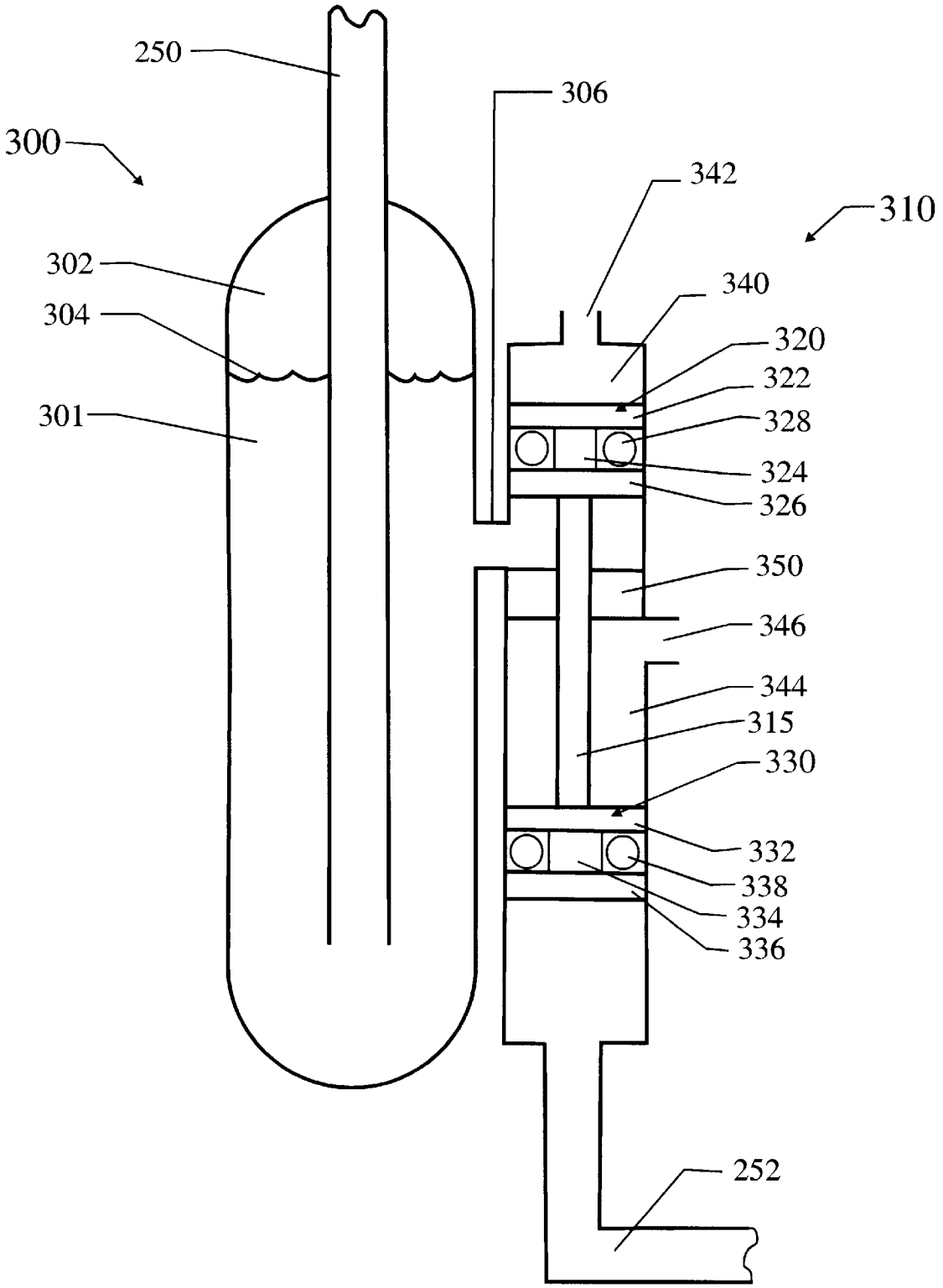
FIG. 3 illustrates the pressure reservoir and energy converter of FIG. 1 schematically, in more detail than shown in FIG. 1.

Motor 200 requires a source of pressure, which is derived from pressure reservoir 300, illustrated schematically in more detail in FIG. 3. Reservoir 300 contains in a majority thereof working fluid 301. However, a smaller chamber 302 of compressed air acts as a pressure source. A small filling valve, not shown, would typically be provided for the introduction of compressed air 302. Compressed air 302 may be separated form the working fluid at interface 304 by some type of a bladder, or may be in direct contact therewith, depending upon the type of working fluid 301 used and the exact composition of the compressed gas used. Note that although air is preferred, air is not the only gas which is suitable. In addition, there are other techniques known in the prior art for separating air 302 from working fluid 301, include the provision of pistons that separate compressed air 302 from working fluid 301.

Reservoir 300 includes a pressure connection 306 which interfaces pressure reservoir 300 to energy converter 310. Converter 310 is primarily divided into two working sections by pressure/vacuum chamber divider 350. The top section includes a pressure piston 320 which has an air side retaining lip 322, a fluid side retaining lip 326, a seal gap 324 and a seal ring 328. Air side retaining lip 322 is exposed to ambient (atmospheric) air pressure through air chamber 340 and ambient vent 342. Fluid side retaining lip 326 is exposed to working fluid 301 ported through pressure connection 306.

Pressure piston 320 is connected through connecting rod 315 to vacuum piston 330. Connecting rod 315 passes through chamber divider 350, and divider 350 will normally include a hydraulic seal therein. Vacuum piston 330 has an air side retaining lip 332, a seal gap 334, a fluid side retaining lip 336 and a seal ring 338. Air side retaining lip 332 is in communication with ambient (atmospheric) pressure through air chamber 344 and ambient vent 346.

When a pressure is first applied to working fluid 301 within reservoir 300, the pressure is applied to fluid side retaining lip 326. This force against pressure piston 320 is not offset on air side retaining lip 332, so pressure piston 320 is forced towards ambient vent 342. However, connecting rod 315 interconnects pressure piston 320 to vacuum piston 330, and thereby an upward force is also applied to vacuum piston 330. The upward force on vacuum piston 330 is counteracted only by transmission of a suction force into vacuum hydraulic line 252. By pressurizing working fluid 301 in reservoir 300, a vacuum force is created in line 252 by energy converter 310.

While the foregoing details what is felt to be the preferred embodiment of the invention and a number of specific alternatives, no material limitations to the scope of the claimed invention are intended. Further, features, materials and design alternatives that would be obvious to one of ordinary skill in the art are considered to be incorporated herein. The scope of the invention is set forth and particularly described in the claims hereinbelow.

I claim:

1. A hydraulic motor comprising a reciprocating cylinder for reciprocating along an axis, said reciprocating cylinder having a piston rigidly attached externally about said cylinder and located within a piston chamber, said piston having a first working surface and a second working surface, said piston dividing said piston chamber into a first main chamber and a second main chamber;

a divider within said reciprocating cylinder dividing said reciprocating cylinder into a first section and a second section and separating said first and second sections from hydraulic fluid exchange between said first and second sections within said reciprocating cylinder;

a first auxiliary chamber axially adjacent a first end of said reciprocating cylinder, said first auxiliary chamber connected to said first section of said reciprocating cylinder and separated from said second section of said reciprocating cylinder by a closure wall;

a second auxiliary chamber adjacent an end of said reciprocating cylinder opposite said first auxiliary chamber, said second auxiliary chamber connected to said second section of said reciprocating cylinder and separated from said first section of said reciprocating cylinder by a closure wall;

a first port passing through said reciprocating cylinder from said first main chamber to said first section of said reciprocating cylinder;

a second port passing through said reciprocating cylinder from said second main chamber to said second section of said reciprocating cylinder.

2. The hydraulic motor of claim 1 further comprising a source of vacuum applied to said first auxiliary chamber and a source of pressure applied to said second auxiliary chamber.

3. The hydraulic motor of claim 2 further comprising valves for control the pressure state of working fluid within said first and second main chambers and said first and second auxiliary chambers, which, when said valves are in a first state causes said reciprocating piston to move in a first direction along said axis, and when said valves are in a second state causes said reciprocating piston to move in a second direction opposite to said first direction along said axis.

4. The hydraulic motor of claim 1 wherein said first port is immediately adjacent said first piston.

5. The hydraulic motor of claim 1 wherein said first port is spaced from said first piston such that said first port is closed at one end of travel of said reciprocating cylinder.

6. The hydraulic motor of claim 1 wherein said divider divides said reciprocating cylinder into two equal halves.

7. A hydraulic-pneumatic power plant comprising:

a hydraulic motor having a reciprocating cylinder for reciprocating along an axis, said reciprocating cylinder having a piston rigidly attached externally about said cylinder and located within a piston chamber, said piston having a first working surface and a second working surface, said piston dividing said piston chamber into a first main chamber and a second main chamber;

a divider within said reciprocating cylinder dividing said reciprocating cylinder into a first section and a second section and separating said first and second sections from hydraulic fluid exchange between said first and second sections within said reciprocating cylinder;

a first auxiliary chamber axially adjacent a first end of said reciprocating cylinder, said first auxiliary chamber connected to said first section of said reciprocating cylinder and separated from said second section of said reciprocating cylinder by a closure wall;

a second auxiliary chamber adjacent an end of said reciprocating cylinder opposite said first auxiliary chamber, said second auxiliary chamber connected to said second section of said reciprocating cylinder and separated from said first section of said reciprocating cylinder by a closure wall;

a first port passing through said reciprocating cylinder from said first main chamber to said first section of said reciprocating cylinder;

a second port passing through said reciprocating cylinder from said second main chamber to said second section of said reciprocating cylinder;

a source of vacuum and a source of pressure which are operatively applied to said first second and second auxiliary chambers; and valves for controlling the pressure state of working fluid within said first and second auxiliary chambers, which, when said valves are in a first state causes said reciprocating piston to move in a first direction along said axis, and when said valves are in a second state causes said reciprocating piston to move in a second direction opposite to said first direction along said axis.

8. The hydraulic-pneumatic power plant of claim 7 wherein said source of pressure further comprises a pneumatic chamber.

9. The hydraulic-pneumatic power plant of claim 7 wherein said source of vacuum is generated by an energy converter driven by said source of pressure.

10. The hydraulic-pneumatic power plant of claim 9 wherein said source of vacuum comprises a first converter piston and a second converter piston operatively interconnected, said first converter piston exposed to ambient on a first surface and to said source of pressure on a second surface, said second converter piston exposed to ambient on a first surface and to a working fluid on a second surface.

* * * * *